US011298949B2

(12) United States Patent
Anderson et al.

(10) Patent No.: US 11,298,949 B2
(45) Date of Patent: Apr. 12, 2022

(54) PRINTING AGENT CONTAINERS

(71) Applicant: HEWLETT-PACKARD DEVELOPMENT COMPANY, L.P., Spring, TX (US)

(72) Inventors: Daryl E. Anderson, Corvallis, OR (US); James Michael Gardner, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/753,415

(22) PCT Filed: Oct. 18, 2017

(86) PCT No.: PCT/US2017/057180
§ 371 (c)(1),
(2) Date: Apr. 3, 2020

(87) PCT Pub. No.: WO2019/078849
PCT Pub. Date: Apr. 25, 2019

(65) Prior Publication Data

US 2020/0307233 A1 Oct. 1, 2020

(51) Int. Cl.
*B41J 2/175* (2006.01)

(52) U.S. Cl.
CPC ..... *B41J 2/17546* (2013.01); *B41J 2/17513* (2013.01); *B41J 2/17566* (2013.01); *B41J 2002/17583* (2013.01)

(58) Field of Classification Search
CPC . B41J 2/17546; B41J 2/17513; B41J 2/17566
See application file for complete search history.

(56) References Cited

U.S. PATENT DOCUMENTS 6,546,794 B2 4/2003 Kim et al.
6,675,646 B2 1/2004 Nishihara
(Continued)

FOREIGN PATENT DOCUMENTS

EP 1285764 A1 2/2003
EP 1389528 A2 * 2/2004
(Continued)

OTHER PUBLICATIONS

ExOsense™ Piezo-Resonant Liquid Level Sensors, 2008, https://archive-resources.coleparmer.com/Manual_pdfs/01369-06,-08,-24,-26,-28,-30,-32,-34.pdf (2 pages).

*Primary Examiner* — Jason S Uhlenhake
(74) *Attorney, Agent, or Firm* — HP Inc. Patent Department

(57) ABSTRACT

It is disclosed a printing agent container having ink an authenticity detection mechanisms comprising: a receptacle having a top wall a bottom wall opposing such top wall and a sidewall between such top wall and such bottom wall; an internal volume defined by such receptacle that contains a printing agent, and a vibration transducer on one of the side walls, wherein the container is to be mechanically coupled to a carriage so that the printing fluid is disposed on the bottom surface, being the vibration transducer to detect a vibration signal induced by the carriage and wherein the container comprises a communication channel to a controller being the controller to receive through the communication channel a container signature from the vibration transducer and to identify a container identification signal associated to the container signature.

19 Claims, 4 Drawing Sheets

(56) References Cited

U.S. PATENT DOCUMENTS

| | | | |
|---|---|---|---|
| 7,114,390 | B2 | 10/2006 | Lizon et al. |
| 7,739,909 | B2 | 6/2010 | Heise et al. |
| 9,110,423 | B1 | 8/2015 | Bartle |
| 9,322,697 | B2 | 4/2016 | Cameron |
| 9,694,579 | B2 | 7/2017 | Li et al. |
| 2015/0314619 | A1 | 11/2015 | Tanami |
| 2017/0015103 | A1 | 1/2017 | Ueki |

FOREIGN PATENT DOCUMENTS

| | | | |
|---|---|---|---|
| EP | 1389528 | B1 | 2/2004 |
| EP | 2103437 | | 9/2009 |
| JP | 2011168002 | A2 * | 1/2011 |
| JP | 2011168002 | A | 9/2011 |
| WO | WO-2010023135 | A1 | 3/2010 |

* cited by examiner

PRINTING AGENT CONTAINERS

BACKGROUND

In many inkjet type dispensers, ink or other printing fluid is supplied to a printhead through a container, the containers may be integral to the printhead or separate from the printhead. Printing agent containers are, in essence, receptacles that contain a volume of printing agent for printers.

Examples of printing agents may be inks, in the case of ink-based printing, or detailing and/or fusing agents in the case of 3D printers.

DETAILED DESCRIPTION

Replaceable agent containers are an essential part of a printing system and, as such, the quality of materials used in the agents themselves and the manufacturing material of the container play an important role in assuring high quality of printing and durability of the printing system. Therefore, mechanisms for monitoring the ink level and for detecting tampering or non-original containers may be present in such containers. In an example, a level and/or a cartridge identification for determining cartridge authenticity may be detected.

The level of the agent available in the agent container may also be determined for other reasons, for example, to determine an appropriate time for replacement of the cartridge and to avoid premature replacement of the cartridge. In some example implementations, the contents of the printing agent container may be all ink (e.g., a filled ink container), ink and air (e.g., a partially-filled ink container), just air (e.g., an empty ink container), or any other agent (e.g., a 3D printing agent). Thus, a level detection signal changes with the level of the agent in the agent container and provides an indication of the level of the agent in the agent container.

In an example, the printing agent container includes an electrical interface, e.g., a printer application specific integrated circuit (ASIC) to determine the level of fluid and/or a printing agent container identification based on a container signature.

In the foregoing, reference is made to the accompanying drawings. The examples in the description and drawings should be considered illustrative and are not to be considered as limiting to the specific example or element described. Multiple examples may be derived from the following description and/or drawings through modification, combination or variation of certain elements. Although certain features are shown and described in conjunction they may be applied separately to the ink tank of this description, also if not specifically claimed. Furthermore, it may be understood that examples or elements that are not literally described may be derived from the description and drawings by a person of ordinary skill in the art.

Figure 1:
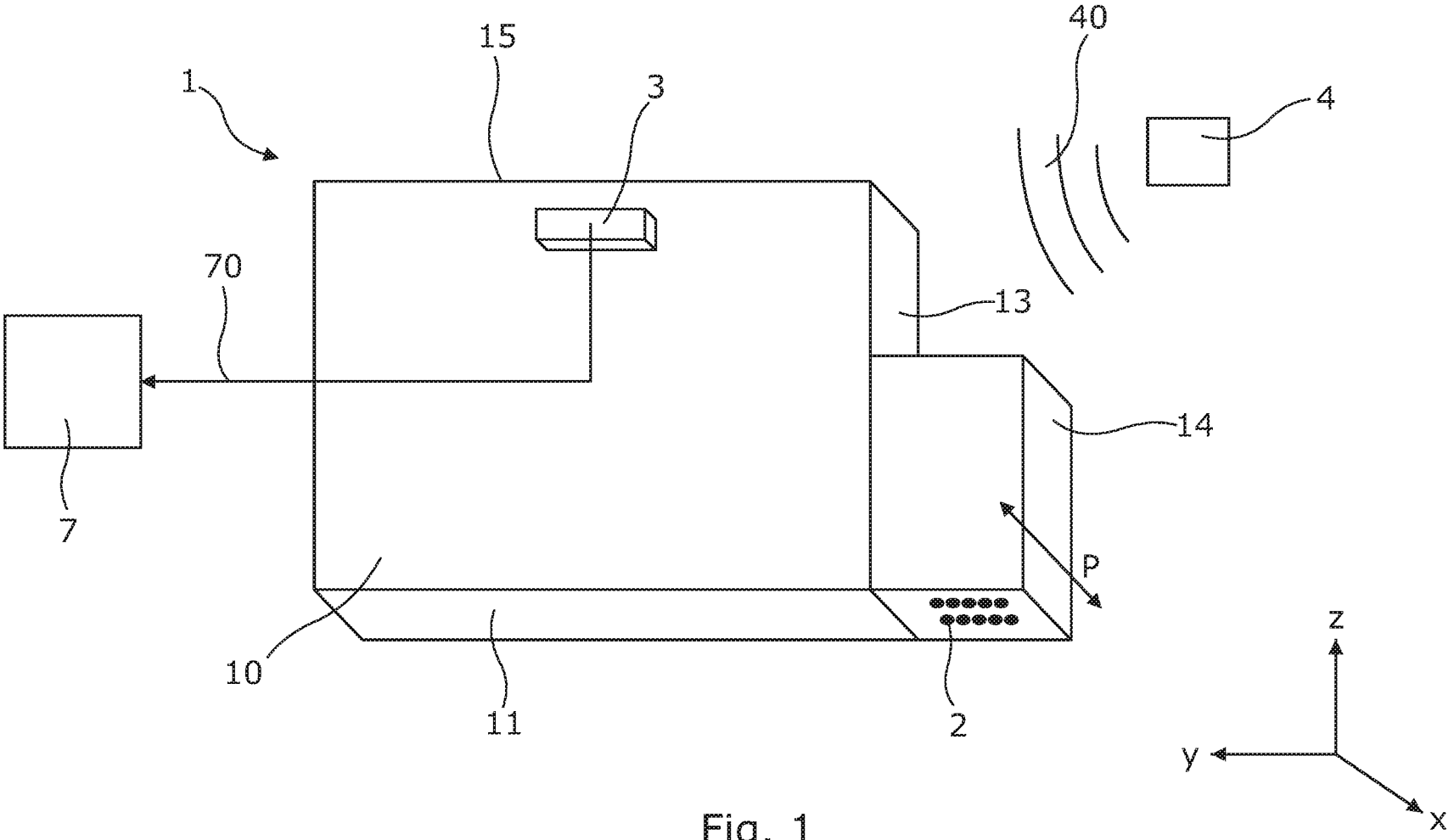
FIG. 1 shows a perspective view of a printing agent container.

FIG. 1 shows an example of printing agent container 1 that comprises a bottom wall 11, a top wall 15 opposite to the bottom wall 11 and a set of side walls between the bottom wall 11 and the top wall 15, namely, a first side wall 10, a second sidewall 12, a third sidewall 13, and a fourth sidewall 14. The bottom wall 11 is to be understood as the wall over which the agent is located while the container 1 is in use, for example, being moved by a carriage along a printing direction P.

The printing agent container may alternatively comprise nozzles 2 in case of integrated printhead cartridges (IPH) or a fluid connection in case of an individual ink (or, agent) cartridge (IIC). Such nozzles 2 or fluid connection are, in an example, located in the lower section of the container, i.e., in the vicinity or in the bottom wall 11.

In use, the printing agent container 1 is mechanically coupled to a carriage 4, e.g., by a mechanical interlock. The mechanical coupling between the container 1 and the carriage has the effect that vibrations are induced to the container 1, e.g., vibrations generated by the carriage due to its movement in a printing process. In an example, the vibrations 40 may be generated by a printing operation, e.g., performing a print, running a calibration proceeding, an impact to a determined surface, or a nozzle capping event.

The printing agent container 1 of FIG. 1 comprises a vibration transducer 3 located on the first sidewall 10. Such vibration transducer 3 is to sense vibrations on the container 1 and, in particular, vibrations generated by carriage 4 and induced to the container 1. In an example, such generated vibrations 40 may be mechanically induced through the mechanical interlock and/or may be acoustically induced by sounds originated in the carriage 4.

The vibration transducer 3 senses the generated vibrations 40 originated in the carriage 4 and generates a container signature that is transmitted to a controller 7 by means of a communication channel 70. In an example, the communication channel 70 is a part of an electrical interface, for example, part of an ASIC.

The container signature will be dependent on the generated vibration 40, on the manufacturing of the container (shape, materials, etc.) and the level of agent contained.

In an example, the generated vibration 40 is a known vibration or, alternatively, is a vibration that can be determined. For example, the vibration may be known due to a previous calibration procedure or factory set up wherein the vibration, e.g., due to a capping event is determined. Also, the vibration may be measured by a further vibration transducer remote from the container 1 and also sent to the controller 7 for its processing.

In another example, the vibration signal may comprise an acoustic signal, e.g., a signal at a determined frequency that may be pre-defined.

Also, the behavior of the vibrations due to the manufacturing of the container i.e., a container signature, can be determined and/or modelled. The container signature depends mostly on the materials used to the manufacturing and the shape of the external and internal components of the container 1. In an example, the contain-er signature can be determined by running a calibration procedure with a known level of ink, e.g., when the container is new and, therefore, full. In a further example, the container signature is modelled and stored in a memory wherein the controller 7 has access to the memory.

Given that the generated vibration 40 is known and/or determined, the container signature received by the controller 7 can be processed (e.g., filtered) to obtain a signal that is dependent on the level of agent contained and the manufacturing of the container 1, i.e., the ink level and the container signature respectively. This signal can, therefore, be used to determine if the container 1 corresponds to an original container (or, at least, a container 1 with compatible shape and quality of materials) and, furthermore, determine the level of agent within the container 1.

Alternatively, artificial intelligence may be used for correlating the container signature to a determined ink level and authenticity of the carriage, e.g., a neural network may communicate with the controller 7 and may be trained to perform such correlation.

Locating the vibration transducer 3 on one of the sidewalls provides the container with an increased accuracy as the vibration transducer is subject to additional vibrations, e.g., due to waves hitting the sidewall.

A sidewall should be understood as any wall that, while the container is mounted on the carriage, is perpendicular to the printing plane. In an example, the sidewall wherein the vibration transducer 3 is located is the sidewall with a normal vector parallel to the printing direction P. In the example of FIG. 1, the printing direction is along the X axis so the printing plane would be the X-Y plane, therefore the candidate walls to incorporate the vibration transducer 3 would be either the wall corresponding to the X-Z plane or the Y-Z plane. In the example of FIG. 1, the vibration transducer 3 is located on the wall defined by a plane with a normal vector parallel to the X axis, i.e., the Y-Z plane.

The vibration transducer 3 is, e.g., a strain-based transducer. The vibration transducer 3 may also be silicon-based as to have low energy consumption and low cost and may be provided to detect variations as low as 1 nm.

In an embodiment, the controller 7 may communicate with a memory on the container 1 or the printing system. Such memory may contain information that is to be correlated with the data acquired by the vibration transducer by the controller 7 as to determine the agent level of the container 1.

Figure 2:
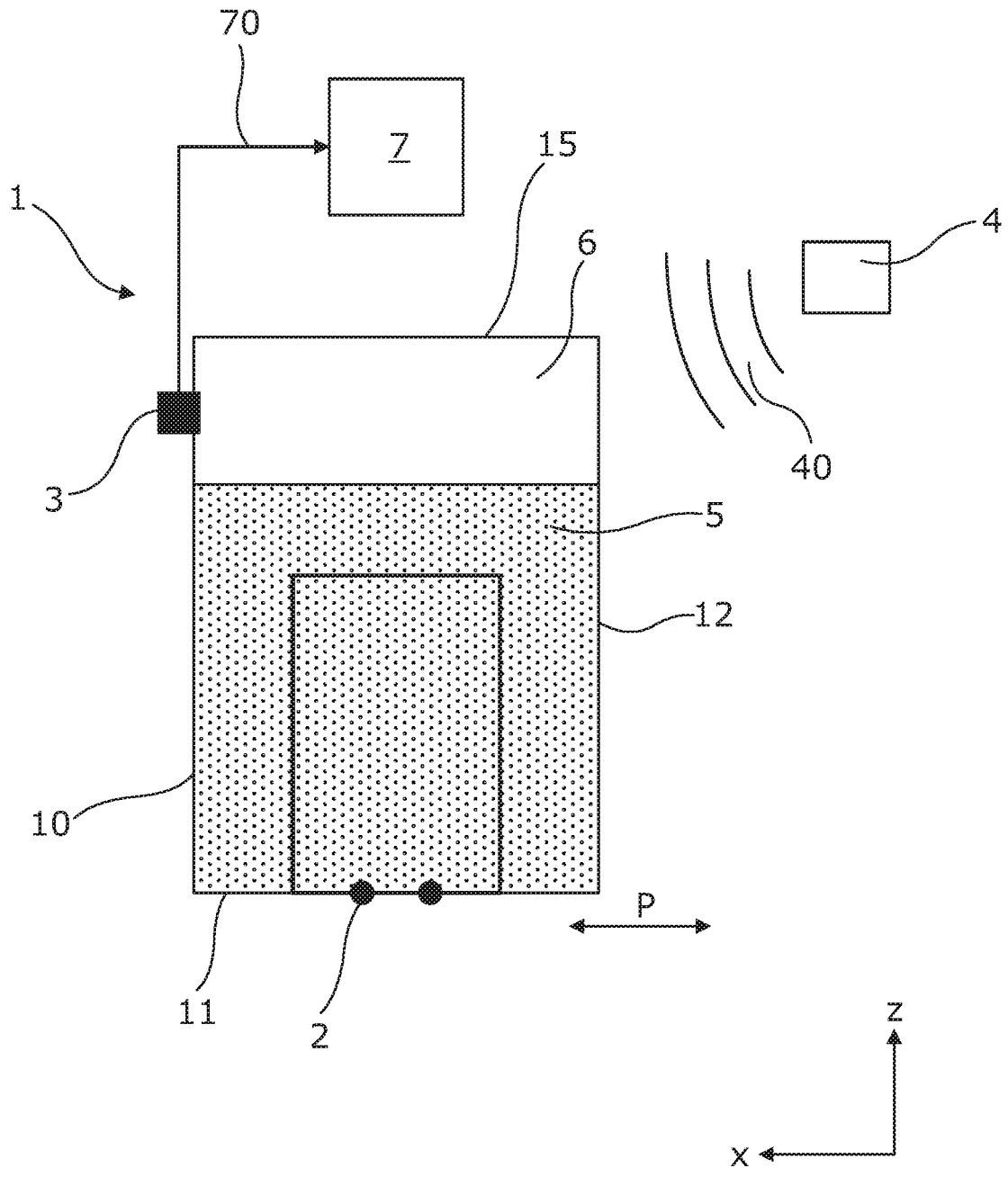
FIG. 2 shows a front view of an example of printing agent container.

FIG. 2 shows a section of a front view of an example of agent container. In the example of container of FIG. 2, it is shown that a receptacle is formed by the walls of the container wherein the receptacle has an agent interface 5 and an air interface 6 being such interfaces defined by the level of agent within the receptacle.

In an example, the vibration transducer 3 is located on the upper portion of the wall as to be coupled close or within the air interface 6 during most of the lifetime of the container 1. Being located on or near the air interface 6 allows the vibration transducer 3 to detect vibrations due to the waves of the fluid thereby having a stronger signal for detecting by the vibrations transducer 3 and, in consequence, for processing by the controller 7. In a further example, an example the vibration transducer 3 may be located near the center of the side wall 10, e.g., between structural ribs of the sidewall 10 to form a diaphragm that may act as an amplifier. Also, locating the on or near the air interface 6 allows for determining the volume of the air interface 6 which may be easier to measure that the agent interface 5.

In general, the container signature is expected to be better defined if the transducer 3 is located away from corners and on surfaces that are unencumbered from vibration.

Figure 3:
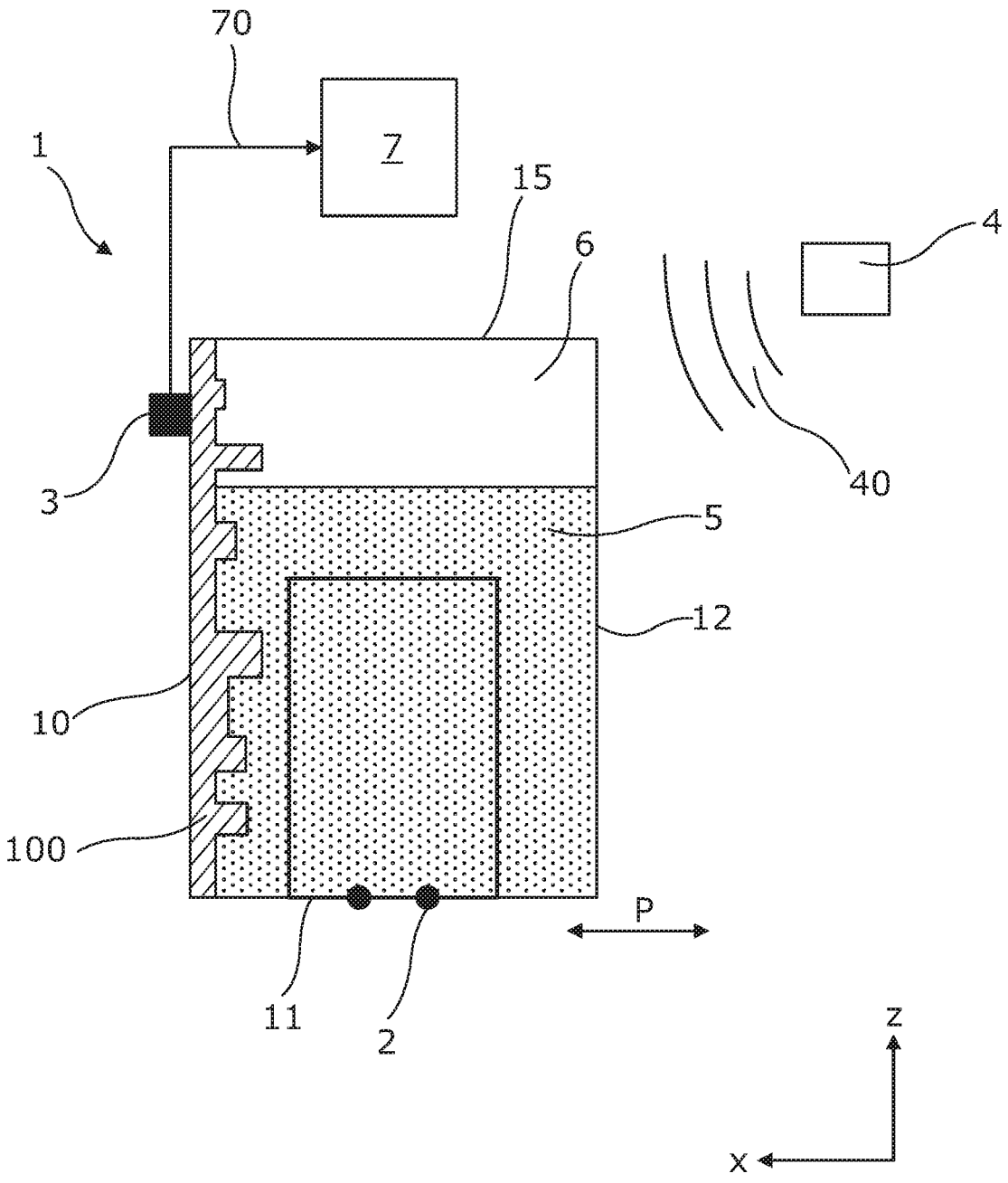
FIG. 3 shows a front view of another example of printing agent container.

FIG. 3 shows a further example of a printing agent container 1. In the example of FIG. 3 the container comprises a first protruding signature element 100. Such first protruding signature element 100 provides for a change in the container signature due to a specific shape of the container side wall 10. Such protruding signature element 100 may be attached to the side wall 10, for example, by adhesives or may be an integral part of the sidewall 10 (for example, molded as part of the container).

In the example of FIG. 3, the protruding signature element 100 is provided along the length of the sidewall 10, however, in other examples, the protruding signature element may only be located partly along the sidewall 10 and have a similar effect. Also, in the example of FIG. 3, the first protruding signature element protrudes into the inner volume defined by the container 1 thereby preventing tampering by third parties.

Figure 4:
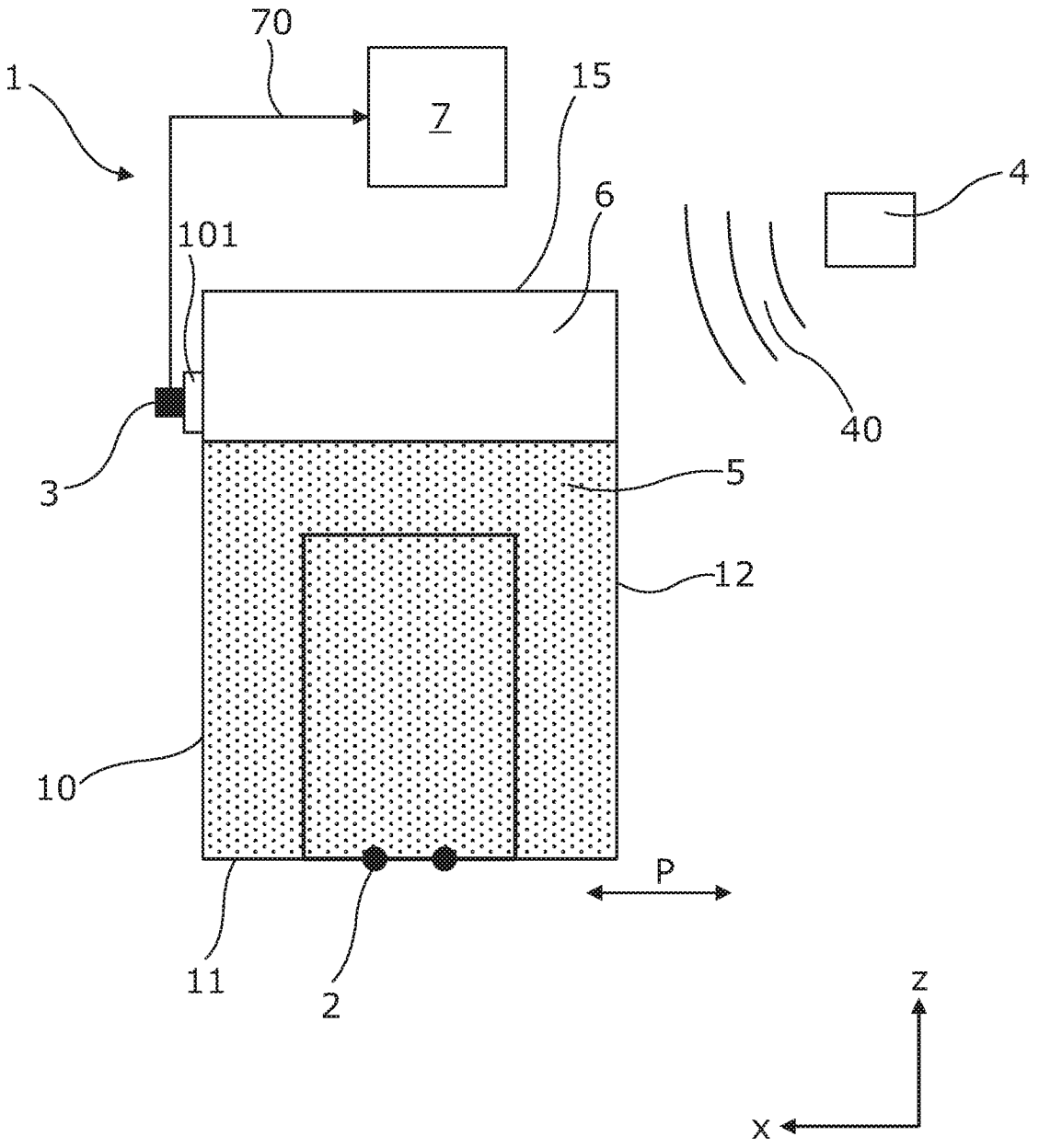
FIG. 4 shows a front view of a further example of printing agent container.

FIG. 4 shows a further embodiment of a container 1 wherein the container comprises a second protruding signature element 101. In this example, the second protruding signature element 101 is an element that protrudes outwards from the sidewall 10.

This example provides for an easier manufacture wherein the second protruding element can be adhered to the sidewall or be an integral part of it (e.g., by molding it together with the sidewall 10 or the container 1 as a whole). The first and second protruding signature elements may different shaper of even comprise manufacturing materials that are different from the sidewalls.

In a further embodiment the protruding signature element may be an element located in the inner volume of the container separated from the sidewalls and, in an example, attached to the bottom and/or top walls of the container.

In essence, it is disclosed a printing agent container comprising:

a receptacle having a top wall, a bottom wall opposing such top wall and a sidewall between such top wall and such bottom wall;

an internal volume defined by such receptacle that contains a printing agent being the printing agent disposed on the bottom surface, and a vibration transducer on one of the side walls, wherein the container is to be mechanically coupled to a carriage and being the vibration transducer to detect a vibration signal induced by the carriage and wherein the container comprises a communication channel to a controller, being the controller to receive a container signature from the vibration transducer and to identify a container identification signal associated to the container signature.

Therefore, there are two vibration signals, the vibration signal issued (or generated) within the carriage environment and the container signature, which is triggered by such vibration signal issued within the carriage but has further information, namely, ink level and container shape information as they have an effect on the signal that is detected by the vibration sensor. Then, the vibration sensor detects this signal and sends it to a controller in the form of a container signature.

In an example, the vibration signal induced by the carriage is generated by a printing operation. Furthermore, the vibration signal may be induced by the carriage e.g., through a movement of the carriage as naturally occurring vibrations during the printing process.

The container signature may comprises an ink level signal, i.e., the container signature depends on the amount of ink within the container, therefore, the controller may be able to also determine an ink level from the container signature.

In an example, the vibration transducer is a strain-based transducer, e.g., a silicon-based strain transducer.

As for the communication between the container and the controller, the communication channel may be a wired communication channel. For example, using a printer specific ASIC incorporated in the container and that provides for electrical connection to the printer. Also, the controller may be part of a printer.

In a further example, the vibration signal induced by the carriage may comprise an acoustic signal or, furthermore, be an acoustic signal generated remotely from the container.

Further, the container may comprise a protruding signature element wherein such element may be an element protruding from at least one of the walls, in particular, one of the side walls.

The protruding signature element may be located within the internal volume either as a part of a wall or being part of the wall. In a further example, the element is attached to one of the walls and is located within the internal volume.

Also, it is disclosed a printing agent container identifying method for a container having a sidewall, a top wall and a bottom wall defining an internal volume wherein printing agent is disposed on the bottom surface, the method comprising:

measuring by a vibration transducer located on the sidewall of the container a vibration signal induced by a carriage to which the container is to be mechanically coupled; and transmitting a container signature by the vibration transducer to a controller.

In an example, the method further comprises identifying by the controller a container identification signal from the container signature. In particular, the controller may be to correlate the container signature to at least one of an ink level or a container identification that allows for determining if a container is authentic.

In an example, the method comprises identifying by the controller an ink level of the container from the container signature.

As for the vibration signal, such signal may be induced by the carriage is generated by a movement of the carriage as naturally occurring vibrations that may comprise, e.g., an acoustic vibration.

The invention claimed is:

1. A printing agent container comprising:

a receptacle having a top wall, a bottom wall opposing the top wall and a sidewall between the top wall and the bottom wall;

an internal volume defined by the receptacle and that contains a printing agent, wherein the printing agent is disposed on the bottom wall;

a vibration transducer on the sidewall, wherein the vibration transducer is to generate a signal representing a vibration detected by the vibration transducer and induced by a carriage when the printing agent container is mechanically coupled to the carriage;

a memory storing information including a container signature of the printing agent container; and a communication interface to a controller, wherein the communication interface is to transmit, to the controller, the signal generated by the vibration transducer and the information stored in the memory for correlation of the signal and the information by the controller.

2. The printing agent container of claim 1, wherein the signal induced by the carriage is responsive to a printing operation.

3. The printing agent container of claim 1, wherein the signal is responsive to a movement of the carriage.

4. The printing agent container of claim 1, wherein the container signature comprises an ink level signal.

5. The printing agent container of claim 4, wherein the controller is to determine an ink level from the container signature.

6. The printing agent container of claim 1, wherein the vibration transducer is a strain-based transducer.

7. The printing agent container of claim 1, wherein the communication interface is a wired communication interface.

8. The printing agent container of claim 1, wherein the signal comprises an acoustic signal.

9. The printing agent container of claim 1, comprising a protruding signature element.

10. The printing agent container of claim 9, wherein the protruding signature element is an element protruding from the sidewall.

11. The printing agent container of claim 9, wherein the protruding signature element is located within the internal volume.

12. The printing agent container of claim 1, wherein the correlation is to determine a level of the printing agent in the internal volume.

13. The printing agent container of claim 1, wherein the container signature stored in the memory is based on a calibration procedure of the printing agent container.

14. A method for a printing agent container having a sidewall, a top wall, and a bottom wall defining an internal volume, wherein a printing agent is disposed on the bottom wall, the method comprising:

storing, in a memory of the printing agent container, information including a container signature of the printing agent container;

measuring, by a vibration transducer located on the sidewall of the printing agent container, a vibration induced by a carriage to which the printing agent container is to be mechanically coupled;

generating, by the vibration transducer, a signal representing the vibration; and transmitting, by the vibration transducer to a controller, the signal generated by the vibration transducer and the information including the container signature for correlation of the signal and the information by the controller.

15. The method of claim 14, further comprising generating, by the controller, a container identification for the printing agent container based on correlating, by the controller, the signal generated by the vibration transducer with the information including the container signature from the memory.

16. The method of claim 14, wherein the signal induced by the carriage is generated responsive to a movement of the carriage.

17. The method of claim 14, comprising:

determining, by the controller, a level of the printing agent in the internal volume based on the correlation.

18. The method of claim 14, wherein the container signature stored in the memory is based on a calibration procedure of the printing agent container.

19. The method of claim 14, wherein the signal is generated during a printing operation in which the carriage is moved.

* * * * *